US005314545A

United States Patent [19]

Folts et al.

[11] Patent Number: 5,314,545

[45] Date of Patent: May 24, 1994

[54] METHOD OF CLEANING AN INTERNAL ACCESS OPENING BY A NOZZLE WITH WEARING CONTACT

[76] Inventors: Michael E. Folts, 216 Fransisco Rd., Grass Lake, Mich. 49240; Mahammed Abdo, 5050 Runnymede, Holt, Mich. 48842

[21] Appl. No.: 882,675

[22] Filed: May 14, 1992

Related U.S. Application Data

[62] Division of Ser. No. 661,126, Feb. 27, 1991, Pat. No. 5,125,425.

[51] Int. Cl.[5] ..... B08B 9/04

[52] U.S. Cl. ..... 134/22.11; 134/22.12; 134/24; 134/34

[58] Field of Search ..... 134/22.11, 22.12, 22.13, 134/22.14, 24, 34, 167 C, 168 C, 172, 198; 239/563, 567, 568, DIG. 19

[56] References Cited

U.S. PATENT DOCUMENTS

| | | | |
|---|---|---|---|
| 2,117,648 | 5/1938 | Bottorf | 134/24 |
| 2,735,794 | 2/1956 | Pletcher | 134/24 |
| 3,080,256 | 3/1963 | Maasberg | 134/24 |
| 3,535,161 | 10/1970 | Gutrich | 134/24 |
| 3,658,589 | 4/1972 | Shaddock | 134/34 |
| 3,705,693 | 12/1972 | Franz | 239/600 |
| 3,750,961 | 8/1973 | Franz | 239/600 |
| 3,756,106 | 9/1973 | Chadwick et al. | 83/177 |
| 3,851,899 | 12/1974 | Franz | 285/95 |
| 4,497,664 | 2/1985 | Verry | 134/22.12 |
| 4,508,577 | 2/1985 | Conn et al. | 134/24 |
| 4,818,298 | 4/1989 | Shishkin et al. | 134/22.14 |
| 4,850,538 | 7/1989 | Krahn | 239/439 |
| 4,909,325 | 3/1990 | Hopmann | 134/22.12 |
| 5,033,681 | 7/1991 | Munoz | 239/596 |

*Primary Examiner*—R. Bruce Breneman
*Assistant Examiner*—Saeed T. Chaudhry
*Attorney, Agent, or Firm*—Ian C. McLeod

[57] ABSTRACT

A nozzle (10) with lateral slots (16, 17 and 18) for discharging a high pressure liquid for treating a work material (30) is described. The nozzle has a constriction orifice (15) between an enlarged or main orifice (13) and restriction orifice (14) leading to the slots which increases the velocity of the liquid issuing from the slots. The nozzle is particularly adapted for deburring transmission fluid channels in transmission main control valve bodies.

21 Claims, 2 Drawing Sheets

METHOD OF CLEANING AN INTERNAL ACCESS OPENING BY A NOZZLE WITH WEARING CONTACT

Figure 1:
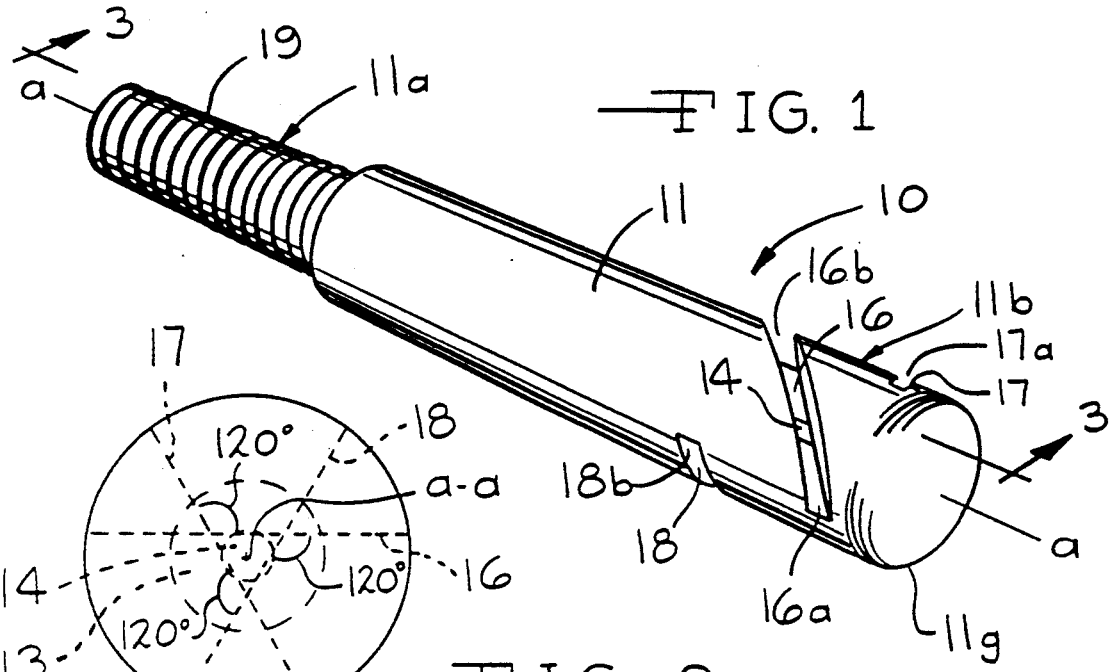

This is a divisional of copending U.S. application Ser. No. 07/661,126 filed on Feb. 27, 1991, now U.S. Pat. No. 5,125,425.

BACKGROUND OF THE INVENTION (1) Field of the Invention

The present invention relates to an improved deburring nozzle particularly adapted for cleaning and deburring an internal opening. In particular, the present invention relates to an elongated nozzle with an internal restricting orifice that is housed inside of the nozzle, spaced from three lateral slots adjacent to the tip of the nozzle. The restricting orifice extends from a main orifice and increases the velocity of a high pressure working liquid pumped through the main orifice, creating a high velocity, high pressure working liquid that is then moved through the lateral discharge slot(s) in the nozzle. Housing the restricting orifice inside the body of the nozzle greatly increases the working life of the nozzle since the restricting orifice does not become chipped, cracked or worn from coming into contact with the working material. Eliminating such contact significantly lengthens the working life of the nozzle because the discharge slot(s) is not the velocity intensifying member in the nozzle. Thus, even if the discharge slot(s) becomes cracked, chipped or worn, the velocity of the jet exiting the nozzle will not be greatly reduced, due to fanning or spreading out of the jet, because the velocity intensifying restricting orifice remains unaffected by any wear to the discharge slot(s) at the tip of the nozzle. The three discharge slots are preferably positioned symmetrically around a longitudinal axis of the nozzle and provide in excess of 360 degrees of coverage of the jet in a hole in a work material into which the nozzle has been probed.

(2) Prior Art

The use of high velocity liquid jets for penetrating a work surface and for cleaning excess material of construction is well known to the prior art. The prior art nozzles are designed to be mounted in a nozzle assembly or holder. The work material passes in front of the nozzle, with the jet penetrating the work material. The velocity intensifying orifice or the restricting orifice of the prior art nozzles is usually positioned at the tip of the nozzle and functions as the jet exit from the nozzle. The prior art nozzles are not typically subjected to a striking or hitting contact with the work material. There is therefore little risk of damage to the restricting orifice which would significantly diminish the velocity of the jet exiting the restricting orifice at the tip of the nozzle. Illustrative of the prior art nozzles are U.S. Pat. Nos. 4,497,664 to Verry; 3,851,899 to Franz; 3,756,106 to Chadwick et. al; 3,750,961 to Franz; and 3,705,693 to Franz.

High velocity jets have been adapted for use in cleaning or deburring excess material of construction from transmission fluid channels of a transmission main control valve body or like openings. These high velocity jets are produced by a nozzle having an elongate body which produces a jet pattern that almost completely covers the entire radial area around the axis at the tip of the nozzle. In these prior art nozzles, a slot(s) at the tip of the nozzle serves as the restricting orifices and there is a straight internal passage to the slot(s) in the nozzle. Thus, the velocity increase comes from the slot(s) which has a very small dimension, typically 0.010 cm to 0.125 cm. The problem is that the slot(s) is damaged when it contacts the work material. This damage will enlarge the slot(s) and liquid exiting the slot(s). Also, the slot(s) wears out from the fluid motion.

OBJECTS

It is therefore an object of the present invention to provide an improved nozzle for cleaning and/or deburring a work material wherein the nozzle has an elongated body with a longitudinal axis so that the jet exiting the nozzle will produce almost a complete radial pattern around the longitudinal axis of the nozzle. Further, it is an object of the present invention to provide a nozzle for directing a high velocity, high pressure jet onto a work material wherein the high velocity creating restriction orifice is spaced from the discharge slots so that the restriction orifice will not be subjected to cracking, chipping and wear when the nozzle comes into striking contact with the work material. Further, the wear of the discharge slots does not decrease the velocity of the fluid because of the presence of the internal restriction orifice Still further, it is an object of the present invention to provide a nozzle adapted for cleaning a work material or for deburring excess material from the transmission fluid passageways in a transmission main control valve body or the like. These and other objects will become increasingly apparent to those skilled in the art by reference to the following descriptions and to the drawings.

DRAWINGS

FIG. 1 is a front cross-sectional view of the preferred nozzle 10 of the present invention.

Figure 2:
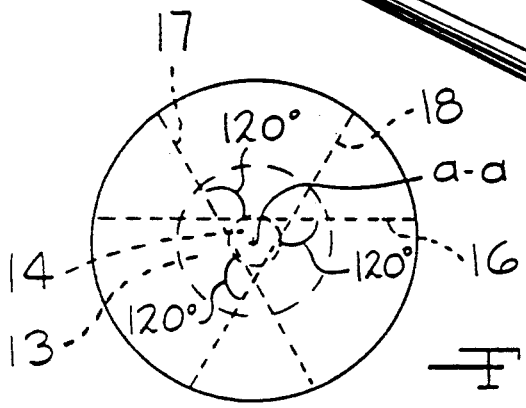

FIG. 2 is an end view of the nozzle 10 showing the angle of the planes of the three discharge slots 16, 17 and 18 in liquid communication with a restriction orifice 14 and a main orifice 13.

Figure 3:
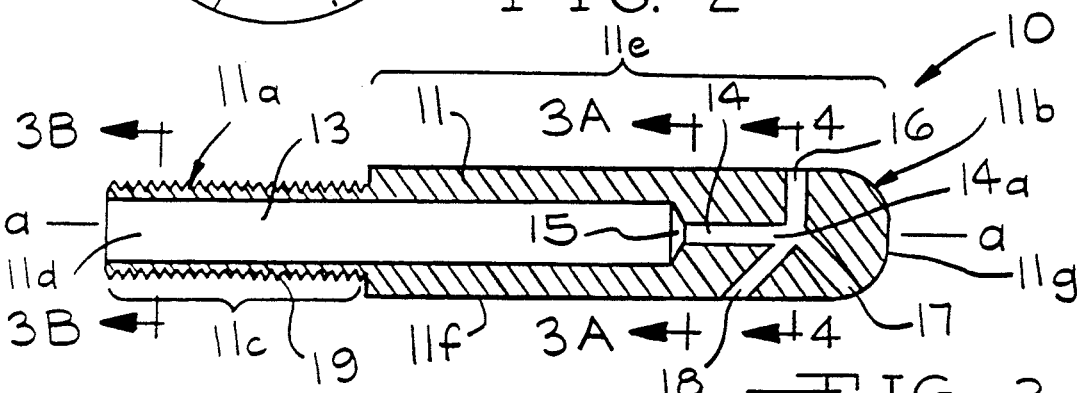

FIG. 3 is a cross-sectional view along line 3—3 of FIG. 1 showing a main orifice 13 in liquid communication with a constriction orifice 15 and the restriction orifice 14 leading to three discharge slots 16, 17 and 18.

Figure 3A:
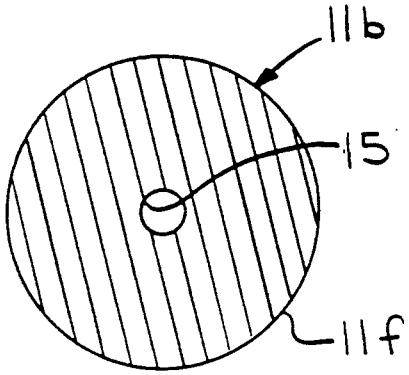

FIG. 3A is a cross-sectional view along line 3A—3A of FIG. 3 showing the constriction orifice 15.

Figure 3B:
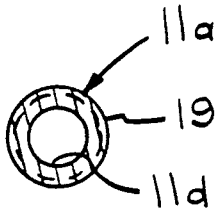

FIG. 3B is a cross-section along line 3B—3B of FIG. 3 showing the main orifice 13 in a proximal portion 11*a* of the nozzle 10 with external threads 19.

Figure 4:
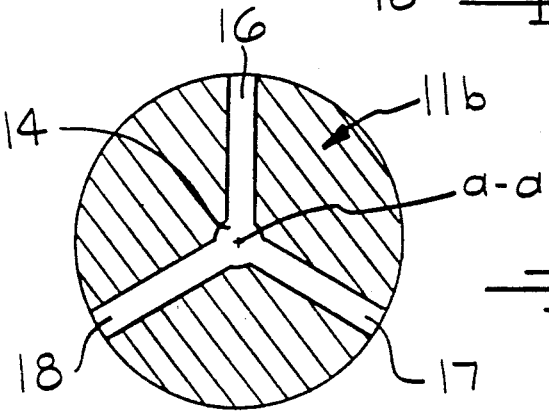

FIG. 4 is a cross-sectional view along line 4—4 of FIG. 1 showing the slots 16, 17 and 18.

Figure 5:
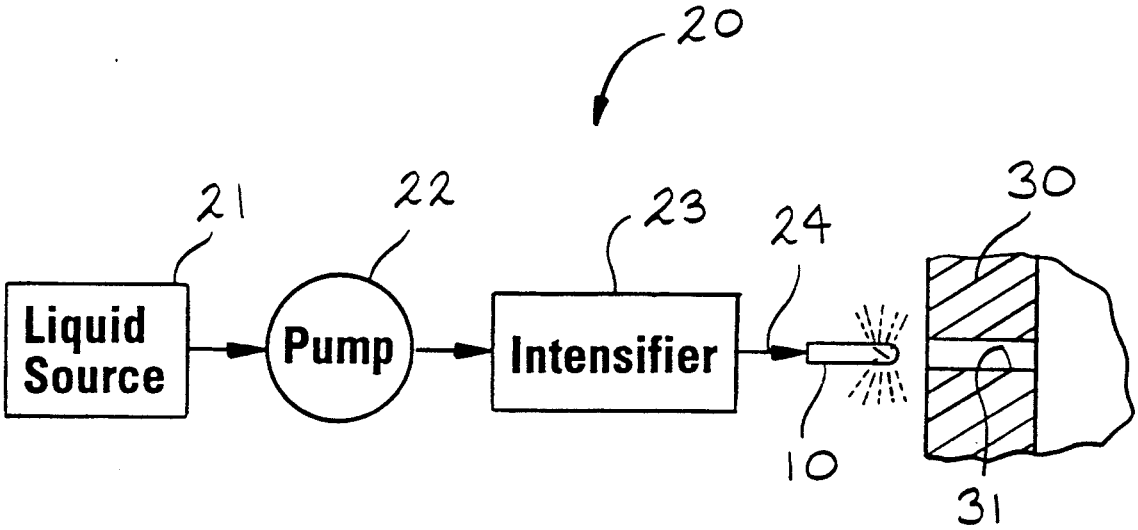

FIG. 5 is a schematic view of the system for cleaning and/or deburring a work material 30 with a opening 31.

GENERAL DESCRIPTION

The present invention relates to a nozzle adapted for delivering a high pressure liquid to a work material which comprises: a shaped body adapted to accommodate the surface to be worked on and having spaced apart ends along a longitudinal axis of the body with an external sidewall between the ends, wherein one of the ends has an opening and the other end is closed; an internal liquid passageway along the axis of the body and extending part of a length of the sidewall from the open end of the body to an end of the internal liquid passageway adjacent to the closed end of the body wherein an internal diameter of the passageway has a constriction from the open end to the end of the internal liquid passageway; at least one discharge slot means through the sidewall of the body along a plane intersecting the longitudinal axis of the body and in liquid communication with the end of the internal liquid passageway adjacent to the closed end of the body and leading to the constriction of the passageway; and a connection means adjacent to the open end of the body, wherein the shaped body can be connected to a high pressure working liquid source by the connection means so that a working liquid can be moved through the internal liquid passageway and exit from the discharge slot means, onto the work material as a high velocity working liquid.

Furthermore, the present invention relates to a nozzle adapted for delivering a high pressure working liquid to a work material for cleaning and for removing thin cross-section materials from the work material which comprises: a shaped body adapted to accommodate the surface to be worked on and having spaced apart ends along a longitudinal axis of the body with an external sidewall between the ends, wherein one of the ends has an opening and the other end is closed; a first internal liquid passageway having an enlarged cross-section along the axis and extending part of a length of the sidewall from the open end; a second internal liquid passageway having a restricted cross-section along the axis and extending from the first liquid passageway part of the length of the sidewall to an end of the second internal passageway adjacent to the closed end of the body wherein there is a constriction of the cross-sections between the passageways; at least one discharge slot means through the sidewall of the body along a plane intersecting the axis of the body and in liquid communication with the end of the second internal liquid passageway; and a connection means adjacent to the open end of the body, wherein the shaped body can be connected to a high pressure working liquid source by the connection means so that a working liquid can be moved through the internal liquid passageway and exit from the discharge slot means, onto the work material as a high velocity working liquid.

The nozzle is usually made of a steel material such as stainless steel, but can be made of any material with sufficient strength for use as a high pressure, high velocity nozzle. The exposed surface of the nozzle is preferably coated with an abrasive resistant material such as a titanium based compound or a titanium nitride material.

The constriction is preferably at least about 30 percent and can be as much as 90 percent. Preferred is between about 50 to 70 percent constriction

SPECIFIC DESCRIPTION

FIGS. 1 to 5 show an improved cleaning and deburring nozzle 10 of the present invention. The nozzle is made of a metal and has an elongate body 11 having a circular cross-section along the longitudinal axis a—a. The body 11 is comprised of a proximal portion 11*a*, a distal portion 11*b* and provides for a first internal liquid passageway or main orifice 13, a second internal liquid passageway or restriction orifice 14 with a constriction orifice 15 and three discharge slots 16, 17 and 18.

The proximal portion 11*a* of the body 11 has a restricted circular cross-section 11*c* along the axis a—a The proximal portion 11*a* has an opening 11*d* and external threads 19 for connecting the nozzle 10 to a high pressure liquid source (not shown). The proximal portion 11*a* could also be provided with a coupling fitting (not shown) for mating the nozzle to a coupling connection. The distal portion 11*b* extends from the proximal portion 11*a* and has an enlarged circular cross-section 11*e* along the axis a—a. The distal portion 11*b* has an abrasion resistant outside wall 11*b* and a rounded end 11*g* remote from the proximal portion 11*a*.

The main orifice 13 has a circular cross-section along the axis a—a and extends from the opening 11*d* the entire length of the proximal portion 11*a* of the nozzle 10 and part of the length of the distal portion 11*b* to the constriction orifice 15. The constriction orifice 15 has a frusto conical shape that tapers from the main orifice 13 downwardly and inwardly towards the axis a—a and the restriction orifice 14. The angle of taper of the constriction orifice 15 ranges between about 15 and 75 degrees. The restriction orifice 14 extends from the constriction orifice 15, part of the length of the distal portion 11*b* to an end 14*a* of the restriction orifice 14 adjacent to the rounded end 11*g* of the distal portion 11*b*.

Three discharge slots 16, 17 and 18 extend from the end 14*a* of the restriction orifice 14 and are spaced in a symmetrical pattern around the axis a—a. Each of the discharge slots 16, 17 and 18 have a rectangular cross-section along a plane intersecting the axis a—a and are in liquid communication with the end 14*a* of the restriction orifice 14, spaced from the axis a—a.

As shown in FIGS. 2 and 4, the discharge slot 16 is first cut into the distal portion 11*b* along a first plane intersecting the axis a—a, to a depth sufficient to communicate with the restriction orifice 14. The second discharge slot 17 is next cut into the distal portion 11*b* along a second plane intersecting the axis a—a, to a depth sufficient to communicate with the restriction orifice 14. The first and second planes of the discharge slots 16 and 17 are offset 120° around the axis a—a. The third discharge is then cut into the distal portion 11*b* along a third plane intersecting the axis a—a, to a depth sufficient to communicate with the restriction orifice 14. The first, second and third planes of the discharge slots 16, 17 and 18 are offset −120° from each other around the axis a—a, thereby forming an equilateral triangle as particularly shown in FIG. 2.

As shown in FIG. 1, an end 16*a* of slot 16 and an end 18*b* of slot 18 are intersected by a first plane parallel to the axis a—a while an end 16*b* of slot 16 and an end 17*a* of slot 17 are intersected by a second plane parallel to the axis a—a. Similarly, ends (not shown) of slots 17 and 18 are intersected by a third plane parallel to the axis a—a. This configuration of discharge slots 16, 17 and 18 produces a spray pattern of working liquid that provides a minimum of 360 degrees of coverage of the jet on a working material and preferably 370 degrees because of overlap and fanning of the work liquid.

FIG. 5 shows a liquid jet system 20 incorporating the nozzle 10 in schematic form. The system 20 includes a source 21 of a working liquid, preferably water under pressure. Water with soluble oils and solvents or chemicals that will not attack or leach out metals of construction of the nozzle 10 are also preferred. The working liquid source 21 is connected to a high pressure pump 22 and intensifier 23 that raises the pressure of the working liquid to a sufficiently high pressure for delivery to the nozzle 10 for cleaning or deburring a work material 30 with a hole 31. This pressure delivered by the intensifier 23 to the nozzle 10 can range between 1,000 and 20,000 PSI, preferably between 1,000 and 12,000 PSI.

After the working liquid has been pressurized as a high pressure liquid by the intensifier 23, the working liquid is then transmitted to the nozzle 10 through a high pressure conduit 24. The connection between the conduit 24 and nozzle 10 is preferably accomplished by providing the proximal end 11*a* of the nozzle 10 and the connecting end of the conduit 24 with mating threads 19, interconnecting coupling connections (not shown) or other suitable connection means.

The body 11 of the nozzle 10 is an elongated cylinder, with a longitudinal axis. The discharge slots 16, 17 and 18 are spaced symmetrically around the longitudinal axis of the nozzle 10. This enables the nozzle 10 to provide a jet pattern of more than 360 degrees around the circumference of the nozzle 10 and the longitudinal axis. The nozzle 10 has a maximum diameter perpendicular to the longitudinal axis and is adapted to be easily inserted inside a transmission fluid channel (not shown) in a transmission main control valve body (not shown). The preferred dimensions of the nozzle 10 are:

| | |
|---|---|
| length of passageway 13 | 0.109 in. (0.276 cm.) |
| length of passageway 14 | 0.0470 in. (0.119 cm). |
| length of nozzle 10 | 1.375 in. (3.49 cm.) |
| diameter of nozzle 10 | 0.250 in. (0.635 cm.) |
| width of slots 16, 17 and 18 | 0.032 in. (0.81 cm.) |
| angle of slots 16, 17 and 18 to axis a-a | 45° |
| threaded area 19 | 0.375 in. (0.953 cm.) |

The ratio of the diameter of the passageway 13 to the passageway 14 is about 2.31 to 1 and preferably between about 2:1 and 10:1. The nozzle 10 can have a diameter of 0.125 inches (0.318 cm) to 1 inch (2.54 cm) and flow rates between about 0.5 GPM and 75 GPM. The internal diameters are in a corresponding ratio to the outside diameters.

It is intended that the foregoing descriptions be only illustrative of the present invention and that the present invention be limited only by the hereinafter appended claims.

I claim:

1. A method for delivering a high velocity working liquid at fluid pressures of about 1,000 to 20,000 pounds per square inch to an internal access opening in a work material for cleaning and for removing thin cross-section materials including burrs from the work material, which comprises:

(a) providing a high pressure liquid source connected to a nozzle means which comprises a unitary nozzle body shaped to fit into the internal access opening in the work material to remove the tin cross-section materials and having spaced apart ends along a longitudinal axis of the nozzle body with an external sidewall between the ends, wherein one of the ends of the nozzle body has an opening and the other end is closed; an internal liquid passageway having a circular cross-section along the longitudinal axis of the nozzle body and extending part of a length of the sidewall from the open end of the nozzle body to an end of the internal liquid passageway adjacent to the closed end of the nozzle body, wherein a diameter of the internal liquid passageway has a constriction between the open and the closed ends that narrows the internal liquid passageway a ratio of at least 2:1 to create the high velocity working liquid from the high pressure working liquid; at least one discharge slot means through the sidewall of the nozzle body for emitting the high velocity working liquid onto the work material, wherein the discharge slot means is provided along a plane intersecting the longitudinal axis of the nozzle body and is in liquid communication with the internal liquid passageway, adjacent to the closed end of the nozzle body and leading to the constriction in the internal liquid passageway and wherein the construction in the internal liquid passageway is in an upstream position with respect to the discharge slot means; and a connection means adjacent to the open end of the nozzle body, wherein the nozzle body can be connected to a high pressure working liquid source by the connection means so that the high pressure working liquid can be moved through the internal liquid passageway and exit from the discharge slot means, onto the work material as the high velocity working liquid;

(b) providing the nozzle means into the internal access opening of the work material wherein the external sidewall comes into wearing contact with the internal access opening without damage to the constriction of the internal liquid passageway and without reducing the effectiveness of the high velocity working liquid; and (c) pumping a high pressure working liquid through the internal liquid passageway so that the high velocity working liquid exits from the discharge slot means in the internal access opening of the work material to remove the thin cross-section materials.

2. The method of claim 1 wherein the sidewall of the nozzle body has a circular cross-section along the longitudinal axis and the closed end is rounded.

3. The method of claim 1 wherein the internal liquid passageway comprised of a first internal liquid passageway having an enlarged cross-section along the longitudinal axis and extending part of a length of the sidewall from the open end of the nozzle body and a second internal liquid passageway having a restricted cross-section along the longitudinal axis, and extending from the first internal liquid passageway part of the length of the sidewall of the nozzle body to an end of the second internal liquid passageway adjacent to the closed end of the nozzle body.

4. The method of claim 3 wherein the first and second internal liquid passageways have circular cross-sections along the longitudinal axis and wherein the first internal liquid passageway has a frusto-conically shaped end, remote from the open end of the first internal liquid passageway, that appears towards the longitudinal axis and the second internal liquid passageway with the taper towards the closed end of the nozzle body as the constriction.

5. The method of claim 4 wherein the frusto-conical end of the first internal liquid passageway has a taper of between about 15 to 75 degrees from the longitudinal axis towards the second internal liquid passageway.

6. The method of claim 3 wherein the first internal liquid passageway has an internal diameter that ranges between about 0.040 inches (0.102 cm) and 0.250 inches (0.635 cm) and wherein the second internal liquid passageway has an internal diameter that ranges between about 0.010 inches (0.025 cm) and 0.125 inches (0.318 cm).

7. The method of claim 3 wherein the sidewall of the nozzle body has a proximal portion with a restricted circular cross-section along the longitudinal axis of the nozzle body that provides for the connection means and a distal portion with an enlarged circular cross-section along the longitudinal axis, and wherein the first internal liquid passageway extends through the proximal portion and part of a length of the distal portion of the nozzle body.

8. The method of claim 3 wherein a flow rate through the first and second internal liquid passageways and exiting from the discharge slot means is between about 0.5 and 75 gallons per minute.

9. The method of claim 1 wherein a ratio of an internal diameter of the first liquid passageway and an internal diameter of the second liquid passageway is between about 2:1 and 10:1.

10. The method of claim 1 wherein there are three discharge slot means provided symmetrically around the longitudinal axis of the nozzle body and through the sidewall of the nozzle body, wherein the discharge slot means are in liquid communication with the end of the second internal liquid passageway, and wherein each of the three discharge slot means has a rectangular cross-section along a plane of the discharge slot means with the three planes of the three discharge slot means intersecting the longitudinal axis to form an equilateral triangle.

11. The method of claim 10 wherein each of the three discharge slot means has spaced apart ends along each of the planes of the three discharge slot means wherein adjacent ends of adjacent discharge slot means are intersected by a plane parallel with and intersected by the longitudinal axis of the nozzle body to thereby provide a minimum of 360 degrees of coverage around the longitudinal axis by a jet of high velocity working liquid.

12. The method of claim 11 wherein the coverage of the jet exiting the discharge slot means is 370 degrees around the longitudinal axis of the nozzle body.

13. The method of claim 1 wherein the internal liquid passageway is constricted to deliver the high velocity working liquid which is substantially water.

14. The method of claim 13 wherein the internal liquid passageway is constricted to deliver the high velocity working liquid which is substantially water with a soluble oil provided in the water.

15. The method of claim 13 wherein the internal liquid passageway is constricted to deliver the high velocity working liquid which is substantially water with a solvent provided in the water.

16. The method of claim 1 wherein the connection means are thread means on the sidewall of the nozzle body that can be mated with a conduit means containing the source of high pressure working liquid.

17. The method of claim 1 wherein the connection means is a coupling means on the sidewall of the nozzle body that is coupled to a conduit means containing the high velocity working liquid source.

18. The method of claim 1 wherein the external sidewall of the nozzle body is coated with an abrasion resistant material that prevents wear on the sidewall as the nozzle contacts the work material.

19. The method of claim 18 wherein the abrasion resistant material is a titanium based compound.

20. The method of claim 18 wherein the abrasion resistant material is a titanium nitride material.

21. The method of claim 1 wherein the nozzle body is shaped to remove burred material from the openings in the transmission main control valve body.

* * * * *

UNITED STATES PATENT AND TRADEMARK OFFICE

CERTIFICATE OF CORRECTION

PATENT NO. : 5,314,545

DATED : May 24, 1994

INVENTOR(S) : Michael E. Folts and Mahammed Abdo

It is certified that error appears in the above—identified patent and that said Letters Patent is hereby corrected as shown below:

Column 2, line 25, a period --.-- should be inserted after "orifice" and before "Still".

Column 3, line 54, after "nozzle", --10-- should be inserted.

Column 3, line 63, a period --.-- should be inserted after "a-a".

Column 4, line 36, after "discharge" --slot 19-- should be inserted.

Column 4, line 40, "-120°" should read -- 120° --.

Column 5, line 48 (Claim 1), "tin" should read --thin--.

Column 6, line 49 (Claim 4), "appears" should read --tapers--.

Signed and Sealed this

Thirtieth Day of August, 1994

*Attest:*

Bruce Lehman

BRUCE LEHMAN

*Attesting Officer*

*Commissioner of Patents and Trademarks*